US009360799B2

(12) United States Patent
Itabashi

(10) Patent No.: US 9,360,799 B2
(45) Date of Patent: Jun. 7, 2016

(54) TONER FILLING APPARATUS

(75) Inventor: Nao Itabashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 727 days.

(21) Appl. No.: 13/604,717

(22) Filed: Sep. 6, 2012

(65) Prior Publication Data

US 2013/0055685 A1 Mar. 7, 2013

(30) Foreign Application Priority Data

Sep. 6, 2011 (JP) ..... 2011-194095

(51) Int. Cl.

| | |
|---|---|
| ***B65B 1/04*** | (2006.01) |
| ***B65B 7/00*** | (2006.01) |
| ***G03G 15/08*** | (2006.01) |
| ***B65B 1/20*** | (2006.01) |
| *B65B 1/28* | (2006.01) |

(52) U.S. Cl.
CPC ..... *G03G 15/0879* (2013.01); *G03G 15/0877* (2013.01); *B65B 1/28* (2013.01)

(58) Field of Classification Search
CPC ..... G03G 15/0832; B65B 3/04; B65B 3/12; B65B 3/18
USPC ..... 53/467; 399/262, 258; 141/5, 18, 71, 27
See application file for complete search history.

(56) References Cited

U.S. PATENT DOCUMENTS

| | | | | |
|---|---|---|---|---|
| 4,012,809 | A * | 3/1977 | Warncke | A61F 13/2085 28/120 |
| 4,150,521 | A * | 4/1979 | Reilly | B65B 25/065 452/43 |
| 4,467,499 | A * | 8/1984 | Beckman | A22C 11/02 452/38 |
| 5,740,507 | A | 4/1998 | Ichikawa et al. | |
| 5,921,295 | A * | 7/1999 | Zelazny et al. | 141/286 |
| 5,953,567 | A * | 9/1999 | Muramatsu et al. | 399/256 |
| 6,332,065 | B1 * | 12/2001 | Howard | 399/106 |
| 6,393,241 | B1 * | 5/2002 | Matsumoto et al. | 399/258 |
| 6,567,635 | B2 * | 5/2003 | Livadas et al. | 399/253 |
| 6,679,301 | B2 | 1/2004 | Makino et al. | |
| 6,862,420 | B1 | 3/2005 | Less | |
| 7,110,704 | B2 * | 9/2006 | Sudo et al. | 399/258 |

(Continued)

FOREIGN PATENT DOCUMENTS

| | | |
|---|---|---|
| CN | 1146020 A | 3/1997 |
| CN | 1375426 A | 10/2002 |

(Continued)

OTHER PUBLICATIONS

First Office Action issued in corresponding Chinese Application No. 201210324380.5 mailed Mar. 24, 2014.

(Continued)

*Primary Examiner* — Stephen F Gerrity
*Assistant Examiner* — Eyamindae Jallow
(74) *Attorney, Agent, or Firm* — Banner & Witcoff, Ltd.

(57) ABSTRACT

A toner filling apparatus includes a storing portion and a nozzle. The storing portion includes a storing chamber configured to store toner therein and a pressing member configured to press the toner stored in the storing chamber. The nozzle ejects the toner pressed by the pressing member outside from the storing chamber. The storing portion has an air outlet for releasing air outside from the storing chamber when the pressing member presses the toner.

14 Claims, 10 Drawing Sheets

(56) References Cited

U.S. PATENT DOCUMENTS

| | | | | |
|---|---|---|---|---|
| 7,163,032 | B2 * | 1/2007 | Itabashi | 141/12 |
| 7,218,880 | B2 * | 5/2007 | Yanagisawa et al. | 399/258 |
| 7,249,616 | B2 * | 7/2007 | Turri et al. | 141/67 |
| 2002/0144746 | A1 | 10/2002 | Makino et al. | |
| 2003/0081969 | A1 * | 5/2003 | Muramatsu et al. | 399/258 |
| 2004/0050448 | A1 | 3/2004 | Wegman et al. | |
| 2004/0060611 | A1 * | 4/2004 | Amano et al. | 141/83 |
| 2004/0131392 | A1 * | 7/2004 | Matsumoto et al. | 399/262 |
| 2004/0134560 | A1 | 7/2004 | Sato et al. | |
| 2007/0274740 | A1 * | 11/2007 | Katoh | G03G 15/0849 399/254 |
| 2008/0017272 | A1 | 1/2008 | Isomura et al. | |
| 2008/0110940 | A1 * | 5/2008 | Frates | 222/504 |
| 2009/0247957 | A1 * | 10/2009 | Heutschi | A61M 5/31515 604/220 |
| 2010/0175348 | A1 * | 7/2010 | Fundingsland | A61C 5/062 53/111 R |
| 2012/0091382 | A1 * | 4/2012 | Yie | 251/337 |
| 2013/0216271 | A1 * | 8/2013 | Yamabe | G03G 15/0879 399/258 |
| 2014/0029973 | A1 * | 1/2014 | Terazawa | G03G 15/0879 399/106 |

FOREIGN PATENT DOCUMENTS

| | | | |
|---|---|---|---|
| CN | 1601395 | A | 3/2005 |
| JP | S54-113882 | U | 8/1979 |
| JP | S58183401 | A | 4/1982 |
| JP | S61-269022 | A | 11/1986 |
| JP | S62-146101 | A | 6/1987 |
| JP | 05-046022 | | 2/1993 |
| JP | H11-132148 | A | 5/1999 |
| JP | 2004-061757 | | 2/2004 |
| JP | 2007261687 | A | 10/2007 |
| JP | 2008-158006 | A | 7/2008 |
| JP | 2008152056 | A | 7/2008 |

OTHER PUBLICATIONS

Jan. 21, 2015—(CN) Second Office Action—App 201210324380.5.
Jul. 21, 2015—(JP) Notice of Reasons for Rejection—App 2011-194095—Eng Tran.

* cited by examiner

FRONT ⟷ REAR

FRONT ⟷ REAR

FRONT ⟷ REAR

FRONT ⟷ REAR

FRONT ⟷ REAR

FRONT ⟷ REAR

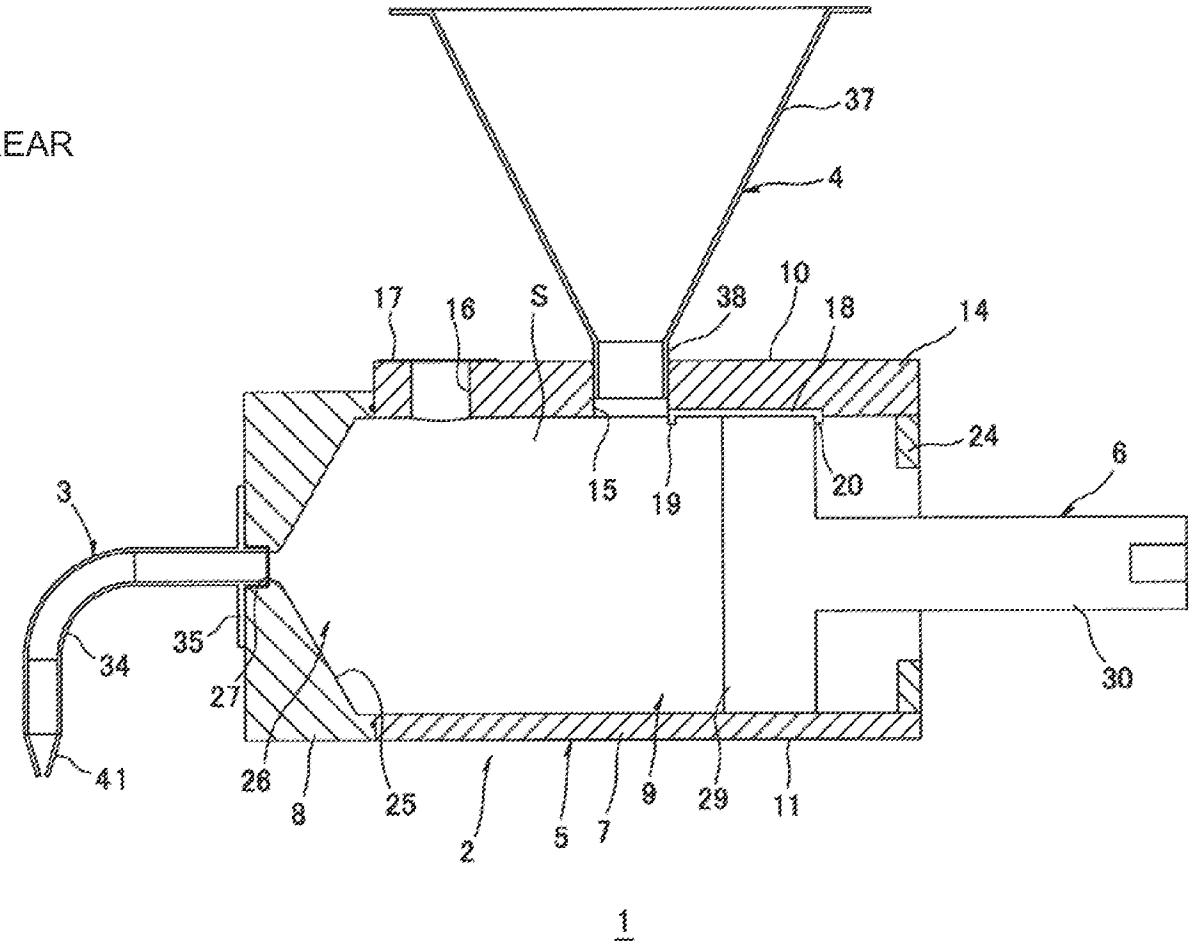
Fig.9
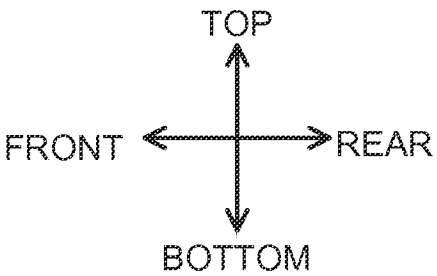

TONER FILLING APPARATUS

CROSS REFERENCE TO RELATED APPLICATION

This application claims priority from Japanese Patent Application No. 2011-194095, filed on Sep. 6, 2011, the content of which is incorporated herein by reference in its entirety.

TECHNICAL FIELD

Aspects of the disclosure relate to a toner filling apparatus configured to fill a toner cartridge with toner.

BACKGROUND

It is known that image forming apparatuses, such as electrophotographic printers, copiers, facsimiles, or multifunction apparatuses, may include detachable developing cartridges filled with developing powder or toner.

As a method of filling a developing cartridge with toner, one proposal has been made to fill the developing cartridge with toner with a density greater than an apparent loose density by inserting a nozzle of a toner filling machine into the inside of a casing of the developing cartridge and filling the developing cartridge with toner under compression from the toner filling machine.

However, when the developing cartridge is filled with the toner with the above method, not only the toner but also air is forced into the developing cartridge, and thus it is difficult to efficiently fill the developing cartridge with the toner in high density.

SUMMARY

Aspects of the disclosure may provide a toner filling apparatus configured to fill a container with high-density toner efficiently.

According to one aspect of the disclosure, a toner filling apparatus may include a storing portion including a storing chamber configured to store toner therein and a pressing member configured to press the toner stored in the storing chamber, and a nozzle for ejecting the toner pressed by the pressing member outside from the storing chamber. The storing portion has an air outlet for releasing air outside from the storing chamber when the pressing member presses the toner.

With this structure, the toner stored in the storing chamber is pressed by the pressing member, transported to the nozzle, and discharged outside therefrom.

At this time, only air, which exists together with the toner in the storing chamber, is released outside from the air outlet.

As a result, the toner in high density can be reliably discharged from the nozzle.

According to another aspect of the disclosure, a method of manufacturing a toner cartridge using a toner filling apparatus, the toner filling apparatus includes a nozzle, a storing chamber, and a pressing member, the toner filling apparatus having an air outlet, the method includes the steps of: connecting the nozzle of the toner filling apparatus with a toner filling port of the toner cartridge; locating the pressing member in a retracted position; supplying toner to the storing chamber of the toner filling apparatus after the locating step; moving the pressing member to press the toner toward the nozzle until a predetermined amount of the toner is discharged into the toner cartridge via the nozzle and the toner filling port after the connecting step and the supplying step; releasing air outside from the storing chamber via the air outlet in accordance with movement of the pressing member in the moving step; disconnecting the nozzle of the toner filling apparatus from the toner filling port of the toner cartridge after the moving step; and closing the toner filling port of the toner cartridge after the disconnecting step.

With the method, the toner cartridge filled with high density toner can be manufactured.

BRIEF DESCRIPTION OF THE DRAWINGS

Illustrative aspects of the disclosure will be described in detail with reference to the following figures in which like elements are labeled with like numbers and in which:

FIGS. 3A to 3F illustrate a method of filling a developer cartridge with toner using the toner filling apparatus, wherein FIG. 3A illustrates a piston located in a retracted position, FIG. 3B illustrates the piston moved frontward to a rear side of a toner supply port from a state shown in FIG. 3A, FIG. 3C illustrates the piston moved frontward to a front side of the toner supply port from a state shown in FIG. 3B, FIG. 3D illustrates the piston moved further frontward from a state shown in FIG. 3C, FIG. 3E illustrates the piston moved to a compression position from a state shown in FIG. 3D, and FIG. 3F illustrates the piston retracted rearward to the toner supply port from a state shown in FIG. 3E;

FIGS. 6A and 6B are sectional views of a toner filling apparatus according to a fourth illustrative embodiment of the toner filling apparatus of the disclosure, wherein FIG. 6A illustrates a piston located in a retracted position and FIG. 6B illustrates the piston moved to a compression position;

FIG. 9 is a sectional view of a toner filling apparatus according to a seventh illustrative embodiment of the toner filling apparatus of the disclosure;

DETAILED DESCRIPTION

A first illustrative embodiment of the disclosure will be described in detail with reference to the accompanying drawings.

Figure 1:
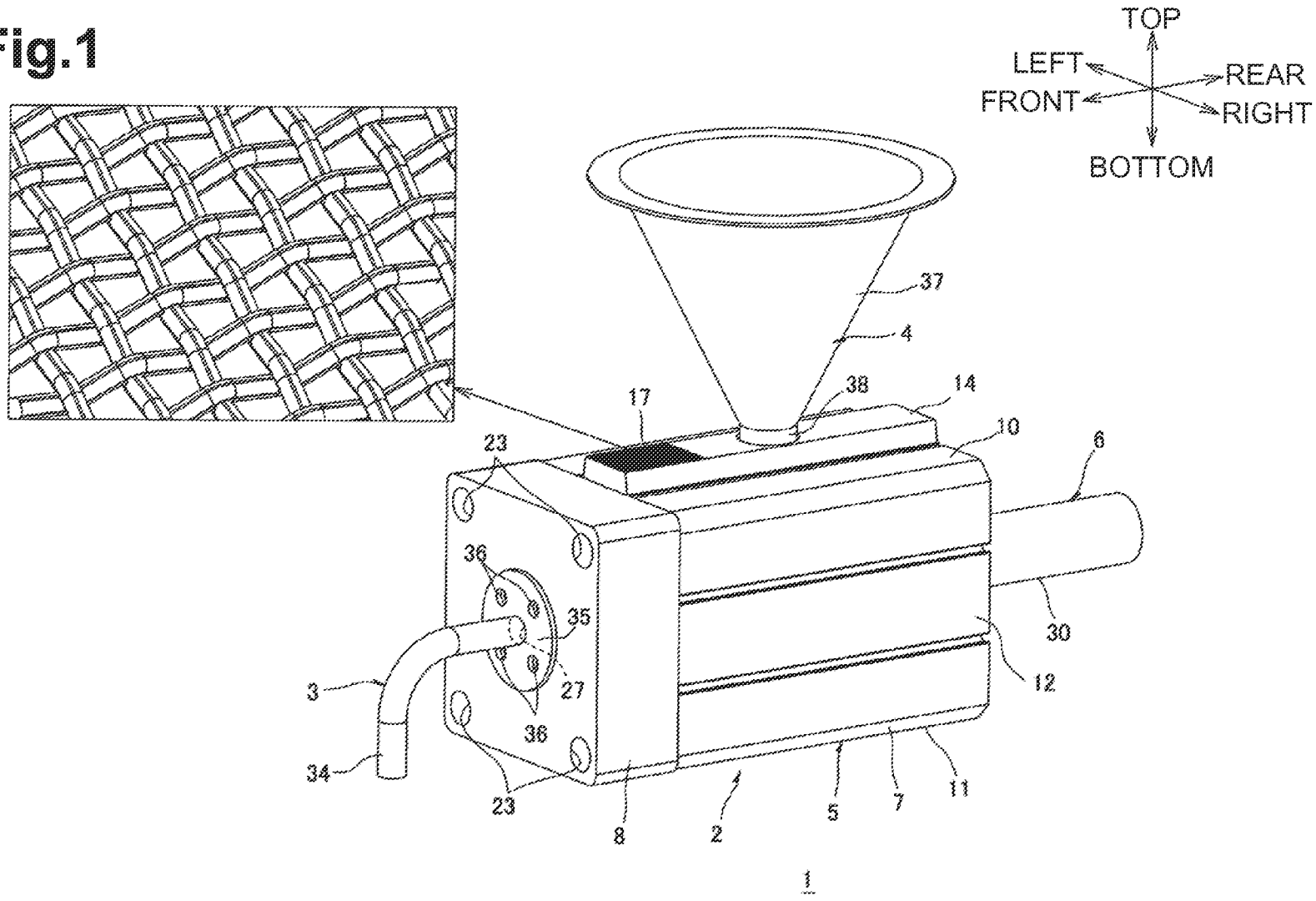
FIG. 1 is a perspective view, looking from the front right side from above, of a toner filing apparatus according to a first illustrative embodiment of a toner filling apparatus of the disclosure.

In FIG. 1, a toner filling apparatus 1 is configured to fill a toner cartridge, which is detachably attachable to an image forming apparatus, e.g., a printer, with toner.

Figure 2:
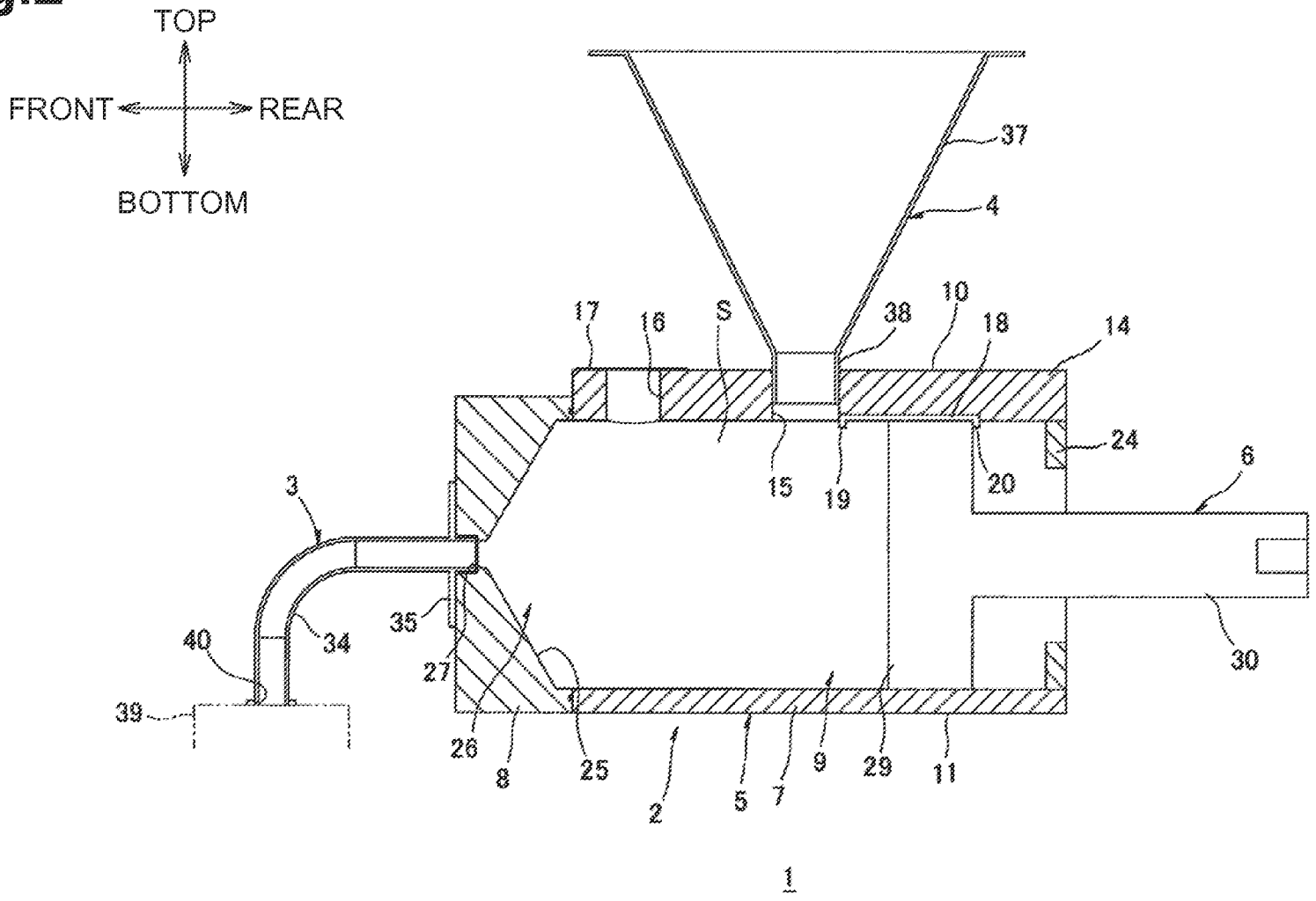
FIG. 2 is a sectional view of the toner filling apparatus shown in FIG. 1.

As shown in FIG. 2, the toner filling apparatus 1 includes a toner storing portion 2, as an example of a storing portion, configured to store toner therein, a nozzle 3 for discharging toner from the toner storing portion 2, and a funnel 4 for supplying toner in the toner storing portion 2.

The toner storing portion 2 includes a toner storing chamber 5, as an example of a storing chamber, configured to store toner therein, and a piston 6, as an example of a pressing member, configured to press the toner stored in the toner storing chamber 5.

In the following description, a side on which the nozzle 3 is disposed (or the left side in FIG. 2) is referred to as a front side (or a downstream side in an advance direction of the piston 6), and an opposite side (or the right side in FIG. 2) is referred to as a rear side (or an upstream side in the advance direction of the piston 6). In addition, a right side and a left side of the toner filling apparatus 1 are defined when the toner filling apparatus 1 is viewed from the front side. The toner filling apparatus 1 is disposed along a horizontal direction, which is a front-rear direction in this embodiment. The directions, front, rear, left, right, top, and bottom, shown in each drawing are referenced based on the directions shown in FIG. 1.

As shown in FIGS. 1 and 2, the toner storing chamber 5 is comprised of a cylinder member 7 and a nozzle mounting member 8 fixed to a front side of the cylinder member 7.

The cylinder member 7 has a cylindrical shape extending in the front-rear direction. More specifically, when viewed from the front side, an outer circumferential surface of the cylinder member 7 is formed into a rectangle, and an inner circumferential surface of the cylinder member 7 is formed into a circle, and an inner space enclosed by the inner circumferential surface is defined as a toner storing space 9 shaped like a cylinder extending in the front-rear direction.

More specifically, the cylinder member 7 integrally includes a top wall 10 and a bottom wall 11, which are spaced apart from and face each other in a vertical direction, and a pair of sidewalls 12, which are spaced apart from and face each other in the horizontal direction and connect end portions of the top wall 10 and the bottom wall 11 in a left-right direction.

Inner circumferential surfaces of the top wall 10, the bottom wall 11, and the sidewalls 12 are each formed like an arc having the same radius of curvature in cross section. The inner circumferential surfaces define the toner storing space 9.

The top wall 10 of the cylinder member 7 includes a protruding portion 14 which protrudes upward and is elongated in the front-rear direction.

The protruding portion 14 is formed in a central portion of the top wall 10 in the left-right direction, and shaped in substantially a rectangle extending in the front-rear direction and protruding upward.

The protruding portion 14 has a toner supply port 15 through which toner is supplied into the toner storing space 9. The toner supply port 15 is located in a center in the front-rear direction. More specifically, the toner supply port 15 is shaped, in cross section, in a circle having a diameter substantially equal to an outer diameter of a funnel mounting portion 38 (described later), and is formed through the protruding portion 14 vertically to provide communication between the toner storing space 9 and outside.

The protruding portion 14 also has an air outlet 16, which is located at the front of the toner supply port 15 and configured to release air outside from the toner storing space 9 outside when the piston 6 presses the toner.

More specifically, the air outlet 16 is shaped, in cross section, in a circle having a diameter substantially equal to the diameter of the toner supply port 15, and is formed through the protruding portion 14 vertically to provide communication between the toner supply space 9 and outside.

A top surface of the protruding portion 14 includes, as an example of a mesh member, a mesh filter 17 configured to cover the air outlet 16.

The mesh filter 17 is flat, and is shaped in substantially a rectangle of a size sufficient to cover the air outlet 16, and is formed of a wire net as shown in an enlarged view of FIG. 1. The mesh filter 17 is affixed to the top surface of the protruding portion 14 at the front end portion thereof to cover the air outlet 16.

The mesh filter 17 has an aperture size small enough to prevent passage of toner particles and allow escape of air. The aperture size is 1×1 (μm) to 10×10 (μm).

A bottom surface of the protruding portion 14 includes a shutter 18 configured to open and close the toner supply port 15.

When viewed from the front side, the shutter 18 has an arc shape having a radius of curvature identical to the inner circumferential surfaces of the cylinder member 7. When viewed in cross section, the shutter 18 is flat, and is shaped in substantially a rectangle sized to cover the toner supply port 15.

The shutter 18 includes, at a front end portion and a rear end portion, a front-side engaging portion 19 and a rear-side engaging portion 20, which protrude downward to engage a pressure portion or a piston head 29, which will be described later.

The front-side engaging portion 19 and the rear-side engaging portion 20 are formed extending in the left-right direction at the front end portion and the rear end portion of the shutter 18.

The bottom wall of the protruding portion 14 includes a pair of substantially L-shaped rails (not shown), which are spaced apart from each other in the left-right direction, extend along the front-rear direction, and are configured to support left and right ends of the shutter 18 from below.

The left and right ends of the shutter 18 are supported by the pair of rails (not shown) such that the shutter 18 is configured to slide along the front-rear direction.

The shutter 18 is configured to slide, along with movement of the piston 6, between an open position (shown in FIGS. 3A and 3B) where the toner supply port 15 is open and a closed position (shown in FIGS. 3C, 3D, 3E, and 3F) where the toner supply port 15 is closed.

A rear end of the cylinder member 7 includes a regulating member 24.

The regulating member 24 has an annular shape. The regulating member 24 has an outside diameter identical to an inside diameter of the cylinder member 7 which is defined by the inner circumferential surfaces of the cylinder member 7, and an inside diameter smaller than an outside diameter of the piston head 29 of the piston 6.

The regulating member 24 is disposed at the rear end of the cylinder member 7 such that its outer circumferential surface engages with the inner circumferential surfaces of the cylinder member 7.

The nozzle mounting member 8 has thickness in the front-rear direction and is shaped like a rectangle.

The nozzle mounting member 8 are substantially identical, in outside shape and circumference, to the cylinder member 7.

A front surface of the nozzle mounting member 8 is flat, and a rear surface thereof forms a cone-shaped recessed portion 25.

The cone-shaped recessed portion 25 is formed partway of the nozzle mounting member 8 in its thickness direction (or front-rear direction) frontward from the rear surface of the nozzle mounting member 8, shares the same axis as the inner circumferential surfaces of the cylinder member 7, and has a cone shape in which a cross sectional area of an opening in a direction perpendicular to the front-rear direction is decreased frontward. When viewed in cross section, the cone-shaped recessed portion 25 is shaped like an isosceles triangle whose vertex is located in the middle of the nozzle mounting member 8 vertically.

The inside diameter of the cone-shaped recessed portion 25 at the rear end is substantially equal to the inside diameter of the cylinder member 7, and the inside diameter of the cone-shaped recessed portion 25 at the front end is substantially equal to the inside diameter of a toner outlet air outlet described below.

The inside space of the cone-shaped recessed portion 25 is defined as a toner supply space 26 forming the inside space of the toner storing chamber 5 together with the toner storing space 9. The toner supply space 26 is gradually narrowing to the toner outlet 27.

The nozzle mounting member 8 is formed with the toner outlet 27. The toner outlet 27 extends from the front end of the cone-shaped recessed portion 25 to the front surface of the nozzle mounting member 8.

The toner outlet 27 is shaped, in cross section, in a circle having the same central axis as the cone-shaped recessed portion 25, and is formed extending with the same diameter from the front end of the cone-shaped recessed portion 25 to the front surface of the nozzle mounting member 8.

Thus, the toner outlet 27 provides communication between the toner supply space 26 and the nozzle 3.

The nozzle mounting member 8 has, at four corners, bolt insertion holes 23 for inserting bolts (not shown). The bolt insertion holes 23 are formed through the nozzle mounting member 8 in the thickness direction (or in the front-rear direction).

The front surface of the nozzle mounting member 8 has four bolt grooves (not shown) spaced at 90 degrees circumferentially around the toner outlet 27 in the middle in both vertical direction and left-right direction.

The nozzle mounting member 8 is disposed such that a rear surface of the nozzle mounting member 8 contacts the front surface of the cylinder member 7. Four bolts (not shown) are inserted into four bolt insertion holes 23 and threaded in four bolt grooves (not shown) formed on the front surface of the cylinder member 7, thereby the nozzle mounting member 8 is fixed to the front side of the cylinder member 7.

Thus, the toner storing chamber 5 is formed to extend toward the toner outlet 27 along the front-rear direction horizontally, and the toner outlet 27 is disposed at the front of the air outlet 16 located at the front of the toner supply port 15.

The piston 6 includes the piston head 29 and a shaft portion 30.

The piston head 29 is shaped like a circular plate. The outside diameter of the piston head 29 is substantially equal to the inside diameter of the cylinder member 7.

The shaft portion 30 has an outside diameter smaller than the outside diameter of the piston head 29, and is shaped like a cylinder extending in the front-rear direction. The shaft portion 30 extends rearward from a center of the rear surface of the piston head 29 so as to share a central axis with the piston head 29.

The piston 6 is disposed such that the piston head 29 is located in the toner storing space 9 of the cylinder member 7 and the shaft portion 30 protrudes rearward from the regulation member 24 of the cylinder member 7.

The piston head 29 is disposed between the front-side engaging portion 19 and the rear-side engaging portion 20 of the shutter 18 in the toner storing space 9 such that the piston head 29 is allowed to engage with the front-side engaging portion 19 or the rear-side engaging portion 20.

The rear end portion of the shaft portion 30 is connected to a drive source, e.g., a pneumatic cylinder.

The piston 6 is advanced or retracted by a driving force from the drive source along the front-rear direction such that outer circumferential surface of the piston head 29 slides on the inner circumferential surfaces of the cylinder member 7 in the toner storing space 9.

In other words, a direction in which the piston 6 is advanced or retracted is parallel to the front-rear direction. More specifically, an advance direction is the same direction as the front direction, while a retraction direction is the same direction as the rear direction. In addition, a direction in which the piston 6 presses is the same direction as the front direction.

Figures 3A, 3B, 3C, 3D, 3E, 3F:
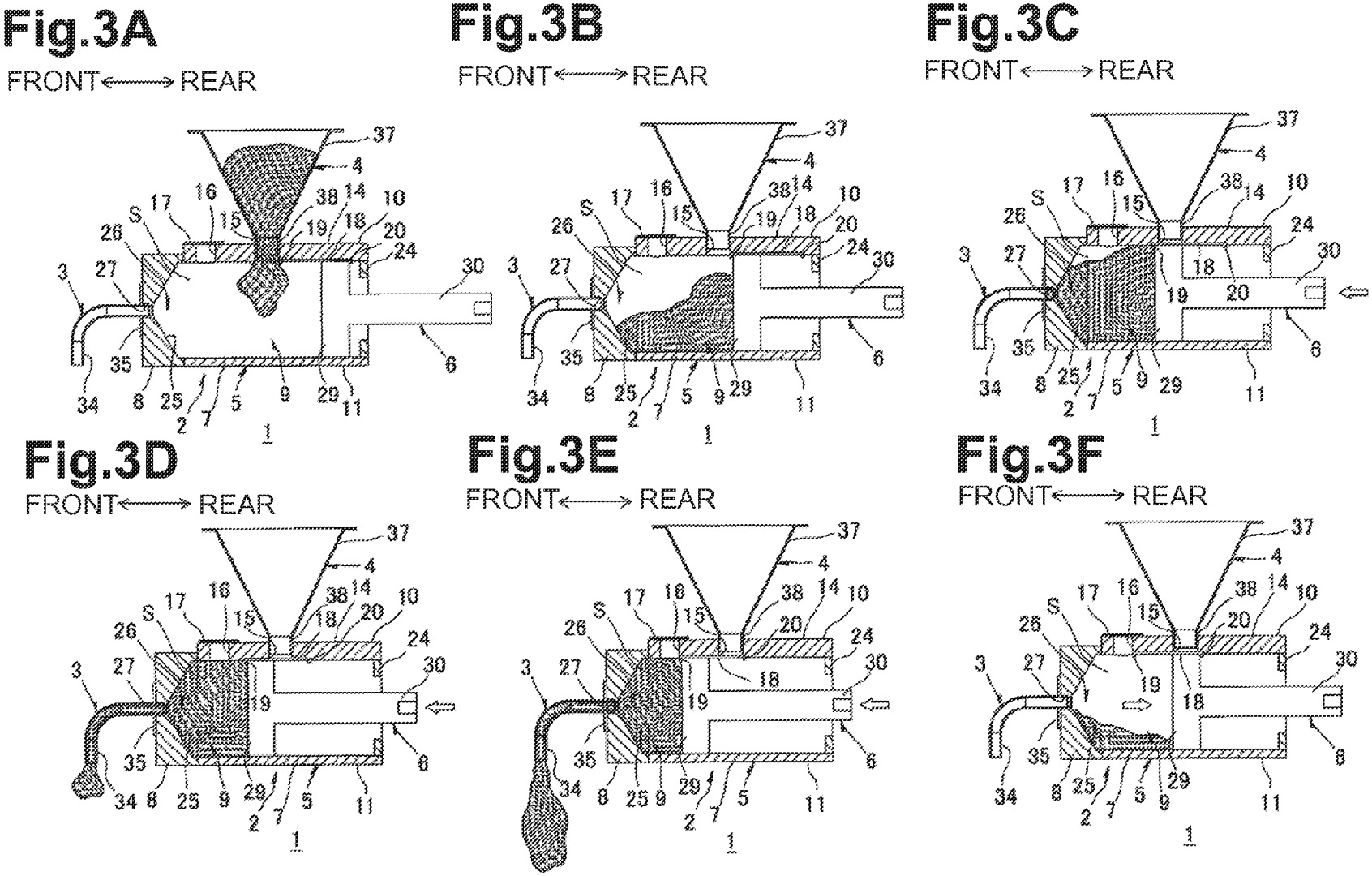

More specifically, the piston 6 is configured to move between a refracted position (FIG. 3A) and a compression position (FIG. 3E). When the piston 6 is in the retracted position, an upper end of the rear surface of the piston head 29 contacts the rear-side engaging portion 20 from the front side and the shutter 18 is located most rearward. When the piston 6 is in the compression position, an upper end of the front surface of the piston head 29 contacts the front-side engaging portion 19 from the rear side and the shutter 18 is located most frontward.

The nozzle 3 includes a nozzle portion 34 and a flange portion 35 disposed at a rear end of the nozzle portion 34.

The nozzle portion 34 is shaped like a cylinder having a diameter substantially equal to the inside diameter of the toner outlet 27. The nozzle portion 34 extends frontward and then is curved downward to have substantially an L-shape.

The flange portion 35 is shaped like an annular ring extending radially outward from the rear end of the nozzle portion 34.

The flange portion 35 has four nozzle attaching holes 36 around the nozzle portion 34, so as to correspond to the four bolt grooves (not shown) formed in the front surface of the nozzle mounting member 8.

The flange portion 35 is disposed such that a rear surface of the flange portion 35 contacts the front surface of the nozzle mounting member 8 and the four nozzle mounting holes 36 are aligned with the four bolt grooves (not shown) of the nozzle mounting member 8. Four bolts (not shown) are inserted into the four nozzle mounting holes 36 and threaded in the four bolt grooves (not shown), thereby the flange portion 35 is coupled to the front side of the nozzle mounting member 8.

The funnel 4 integrally includes a funnel portion 37 and a funnel mounting portion 38 disposed at a lower end of the funnel portion 37.

The funnel portion 37 is shaped like a cone of which a cross-sectional area of an opening is decreased downward.

The funnel mounting portion 38 is shaped like a cylinder coupled to the lower end of the funnel portion 37.

The outside diameter of the funnel mounting portion 38 is substantially equal to the inside diameter of the toner supply port 15 of the cylinder member 7. The funnel mounting portion 38 is inserted into the toner supply port 15 such that the funnel 4 is mounted to the cylinder member 7 to provide communication between the funnel portion 37 and the toner storing chamber 9.

A method for filling a toner cartridge 39 with toner (or a toner cartridge manufacturing process) using the toner filling apparatus 1 will be described with reference to FIGS. 2, 3 and 11.

Figure 11:
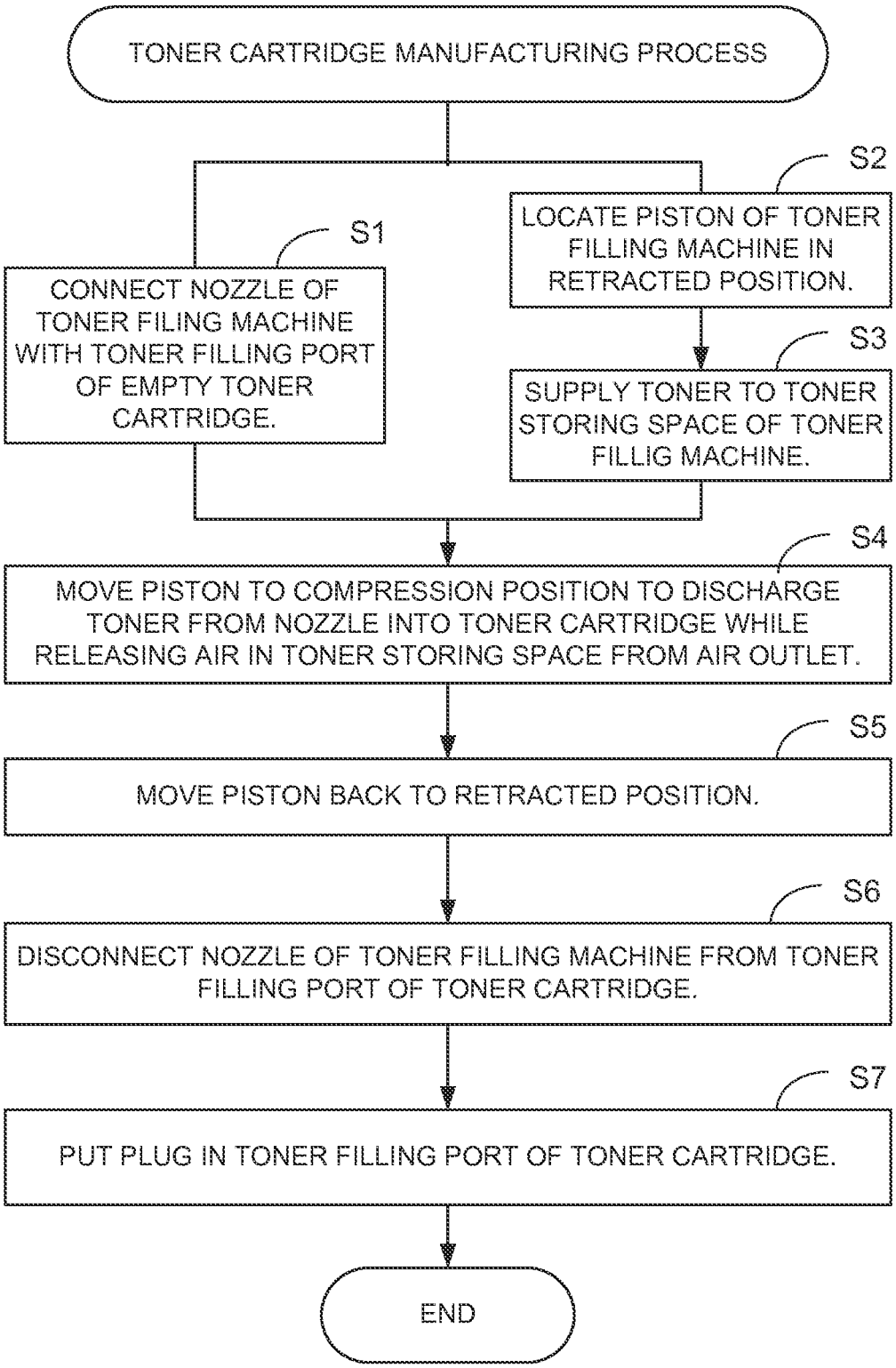
FIG. 11 is a flowchart of a toner cartridge manufacturing process according to aspects of the toner filling apparatus of the disclosure.

To fill an empty toner cartridge 39 with toner using the toner filling apparatus 1, as shown in FIG. 2, the lower end portion of the nozzle portion 34 is inserted into a toner filling port 40 of the toner cartridge 39 (S1 of FIG. 11).

At this time, the piston 6 is located in the retracted position (S2 of FIG. 11). When the piston 6 is in the retracted position, the rear-side engaging portion 20 of the shutter 18 is pressed rearward by the upper end of the rear surface of the piston head 29 and the shutter 18 is located most rearward. The front end portion of the shutter 18 is located behind the toner supply port 15. As the toner supply port 15 is open, the toner storing space 9 communicates with the funnel 4.

As shown in FIG. 3A, toner is supplied to the funnel 4. Toner drops by its weight from the funnel portion 37 through the funnel mounting portion 38 and is supplied to the toner storing space 9 (S3 of FIG. 11). The lower end of the nozzle portion 34 may be inserted into the toner filling port 40 of the toner cartridge 39 (S1) after toner is supplied to the toner storing space 9 (S3).

After a predetermined amount of toner (e.g. a toner level lower than the toner outlet 27, measured from the bottom) is supplied to the toner storing space 9, the piston 6 is advanced frontward or toward the toner outlet 27.

When the piston head 29 is advanced frontward, the upper end of the front surface of the piston head 29 contacts the front-side engaging portion 19, and presses the front-side engaging portion 19 frontward (FIG. 3B).

When the piston 6 is moved further frontward, the piston head 29 presses toner frontward, the upper end of the front surface of the piston head 29 engages the front-side engaging portion 19, the shutter 18 is slid frontward (FIG. 3C), and the toner supply port 15 is closed by the shutter 18.

Along with the frontward movement of the piston 6, the volume of an internal space S located at the front of the front surface of the piston head 29 in the toner storing chamber 5 is gradually reduced. The volume of the internal space S is variable according to the position of the piston 6. In the internal space S being reduced, a ratio of toner subjected to pressure by the piston head 29 gradually increases while a ratio of air, which exists together with toner in the internal space S, gradually reduces because air is released from the air outlet 16.

As shown in FIG. 3D, when the piston 6 is moved further frontward, most of air in the internal space S is released outside from the air outlet 16, and the internal space S is filled with only toner in high density. The toner is discharged from the nozzle 3 and is charged through the toner filling port 40 into the toner cartridge 39 (S4 of FIG. 11).

As shown in FIG. 3E, when the piston 6 is moved further frontward to the compression position, the shutter 18 is located the most frontward, a predetermined amount of toner is discharged into the toner cartridge 39, and filling the toner cartridge 39 with toner is completed.

As shown in FIG. 3F, the piston 6 is then retracted rearward. At this time, toner remaining in the internal space S moves by its own weight from the toner supply space 26 to the toner storing space 9 along the inclined surface of the cone-shaped recessed portion 25.

Then, as shown in FIG. 3A, the piston 6 is moved back to the retracted position (S5 of FIG. 11), and the toner supply port 15 is released from the shutter 18. The lower end portion of the nozzle portion 34 is disconnected from the toner filling port 40 of the toner cartridge 39 (S6 of FIG. 11), the toner filling port 40 is closed (S7 of FIG. 11), and the toner cartridge 39 filled with high density toner is completed.

According to the toner filling apparatus 1, as shown in FIGS. 3A to 3F, toner supplied from the toner supply port 15 to the internal space S of the toner storing chamber 5 is pressed by the piston 6, transported through the toner outlet 27 to the nozzle 3, and discharged into the toner cartridge 39.

At this time, only air, which exists together with toner in the internal space S of the toner storing chamber 5, is released outside from the internal space S of the toner storing chamber 5 through the air outlet 16 formed separately from the toner supply port 15 and the toner outlet 27.

As a result, high-density toner can be efficiently discharged from the nozzle 3.

As the cylinder member 7 includes the air outlet 16, air can be released reliably outside from the internal space S of the toner storing chamber 5. In addition, the position of the air outlet 16 to be formed on the cylinder member 7 can be determined with a high degree of flexibility.

More specifically, the air outlet 16 is disposed at the front of the toner supply port 15. Thus, when toner in the internal space S of the toner storing chamber 5 is pressed by the piston 6, air is pressed frontward along with toner, and released from the air outlet 16.

Thus, air in the internal space S of the toner storing chamber 5 can be efficiently released.

The toner outlet 27 is located at the front of the toner supply port 15, and thus toner is discharged into the nozzle 3 in succession from the front side.

In other words, toner is discharged in the order that toner is supplied to the internal space S of the toner storing chamber and thus deterioration of toner in the internal space S of the toner storing chamber 5 can be reduced.

The nozzle mounting member 8 is formed with the cone-shaped recessed portion 25.

Thus, with frontward movement of the piston 6, toner can be guided from the cone-shaped recessed portion 25 to the toner outlet 27 smoothly.

Thus, toner can be efficiently fed toward the toner outlet 27.

With retraction of the piston 6, toner remaining in the internal space S of the toner storing chamber 5 can be moved from the toner supply space 26 to the toner storing space 9 along the inclined surface of the cone-shaped recessed portion 25.

This can reduce the possibility that the toner outlet 27 is clogged with toner.

In addition, the cone-shaped recessed portion 25 can relieve load on the piston 6 in volume reduction.

The toner storing chamber 5 is formed to extend along the front-rear direction (horizontally) toward the toner outlet 27, and the toner outlet 27 is located at the front of the air outlet 16 located at the front of the toner supply port 15.

When the piston 6 presses toner, it can smoothly press toner toward the nozzle 3 while reducing remaining toner.

The air outlet 16 is disposed in the protruding portion 14 of the top wall 10.

Toner will not be discharged from the air outlet 16 by its own weight only.

Thus, air can be efficiently released from the internal space S of the toner storing chamber 5.

The top wall 10 of the cylinder member 7 includes the shutter 18 which is configured to open and close the toner supply port 15.

As the toner supply port 15 is closed by the shutter 18, backflow of toner at the toner supply port 15 can be prevented during the application of pressure.

The air outlet 16 is covered with the mesh filter 17.

Thus, air can be efficiently released outside from the internal space S of the toner storing chamber 5 and toner can be effectively prevented from being discharged outside from the air outlet 16.

The toner storing portion 2 includes the piston 6. The piston 6 is configured to be moved forward and retracted in the toner storing space 9 of the cylinder member 7.

Thus, as the volume of the internal space S of the toner storing chamber 5 is reduced on average, toner can be uniformly pressed.

A second illustrative embodiment will be described with reference to FIG. 4.

In the above description, the air outlet 16 is formed in the protruding portion 14 of the top wall 10. However, in terms of the fact that toner is not discharged from the air outlet 16 by its own weight only, it is necessary only that the air outlet 16 may be located above a vertical center of the side walls 12. For example, the air outlet 16 may be formed in an upper portion of the sidewalls 12.

In addition, toner is also not discharged from the toner outlet 27 by its own weight only. Thus, as shown in FIG. 4, the toner outlet 27 also may be located above a vertical center of the sidewalls 12.

Figure 4:
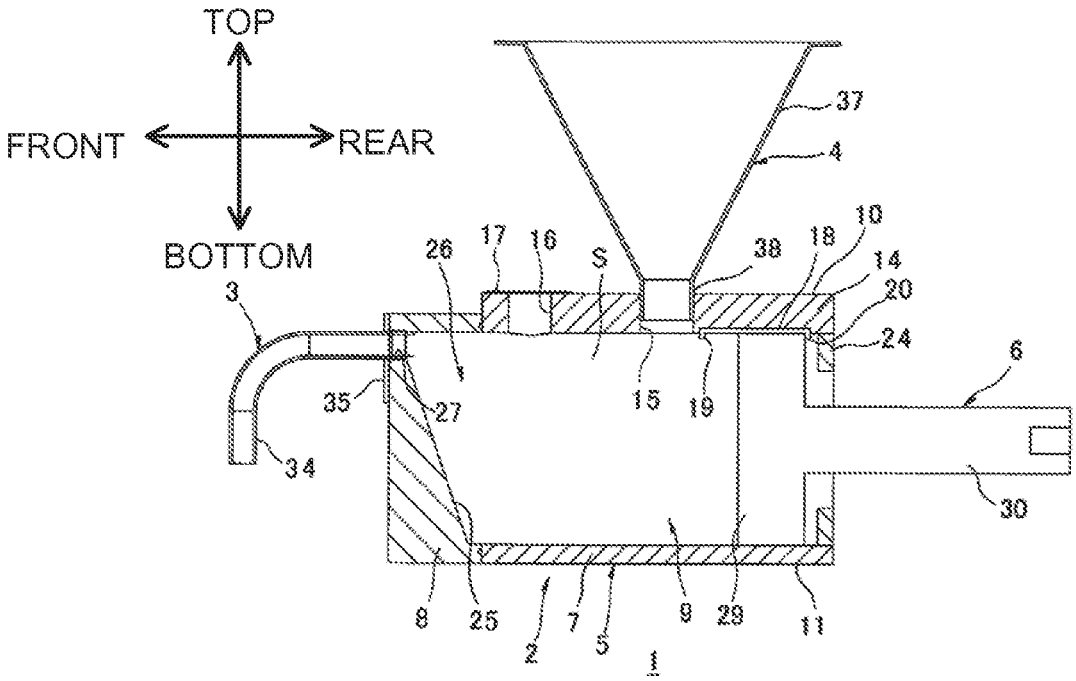
FIG. 4 is a sectional view of a toner filling apparatus according to a second illustrative embodiment of the toner filling apparatus of the disclosure.

In FIG. 4, the cone-shaped recessed portion 25 of the nozzle mounting member 8 is formed in substantially a right angled triangle when viewed in cross section such that the top of the cone-shaped recessed portion 25 is located in an upper end portion of the nozzle mounting plate 8. The toner outlet 27 provides communication between the front edge of the cone-shaped recessed portion 25 and the front surface of the nozzle mounting member 8.

Thus, with the toner outlet 27 being formed in the upper end portion of the nozzle mounting member 8, the possibility that toner is discharged from the toner outlet 27 by its own weight can be effectively reduced.

A third illustrative embodiment will be described with reference to FIG. 5.

Figure 5:
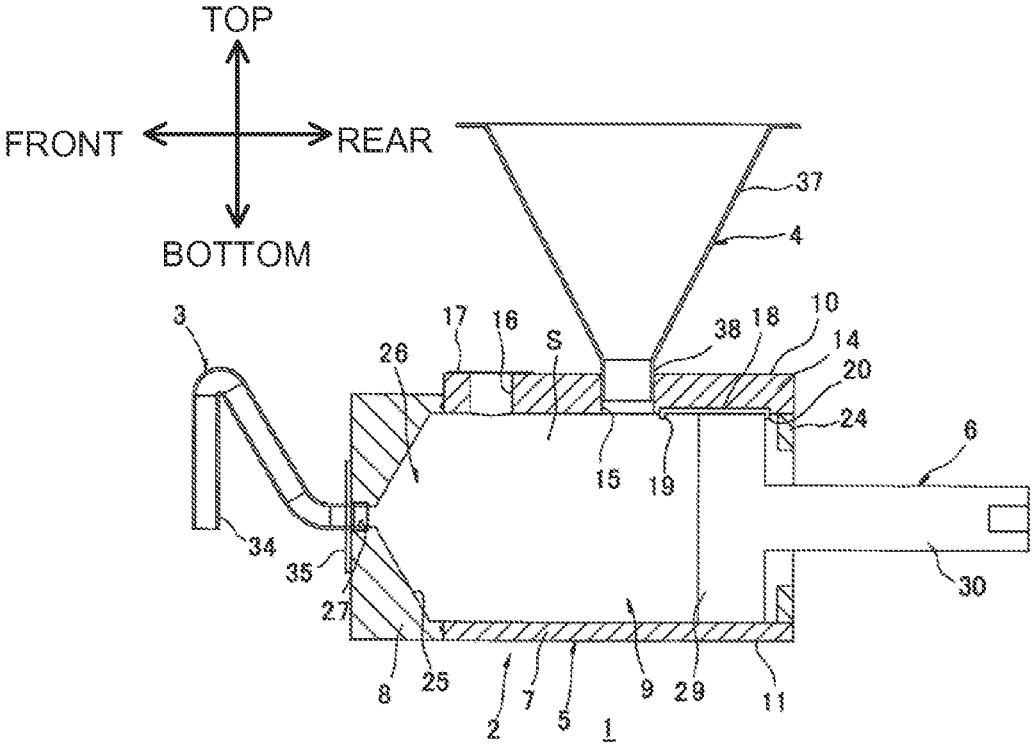
FIG. 5 is a sectional view of a toner filling apparatus according to a third illustrative embodiment of the toner filling apparatus of the disclosure.

As shown in FIG. 5, a part of the nozzle 3 is located above the toner outlet 27 in the vertical direction. With this structure, the possibility that toner is discharged from the nozzle 3 by its own weight can be effectively reduced.

In FIG. 5, the nozzle portion 34 is shaped such that it extends frontward from the flange portion 35 and upward to a point higher than the top wall 10 and is bent downward.

As the nozzle portion 34 extends frontward and upward immediately from the flange portion 35, the possibility that toner flows into the nozzle portion 34 by its own weight can be reduced.

A fourth illustrative embodiment will be described with reference to FIGS. 6A and 6B.

The first embodiment illustrates the piston 6 including the shaft portion 30 and the piston head 29 of which outside diameter is the same as the inside diameter of the cylinder member 7. As shown in FIGS. 6A and 6B, the piston 6 may include the shaft portion 30, the piston head 29 of which outside diameter is smaller than the inside diameter of the cylinder member 7, and an elastic member 46 connecting the inner circumferential surfaces of the cylinder member 7 and the outer circumferential surface of the piston head 29.

More specifically, the elastic member 46 is made of a rubber material, and is shaped in an annular ring. Outer edges of the elastic member 46 are connected to the inner circumferential surfaces of the cylinder member 7 at the rear of the toner supply port 15, and inner edges of the elastic member 46 are connected to the outer edges of the piston head 29.

Thus, the toner storing chamber 5 is partitioned by the elastic member 46 and the piston head 29 into a space behind the elastic member 46 and a space in front of the elastic member 46 (or the internal space S).

Figure 6A:
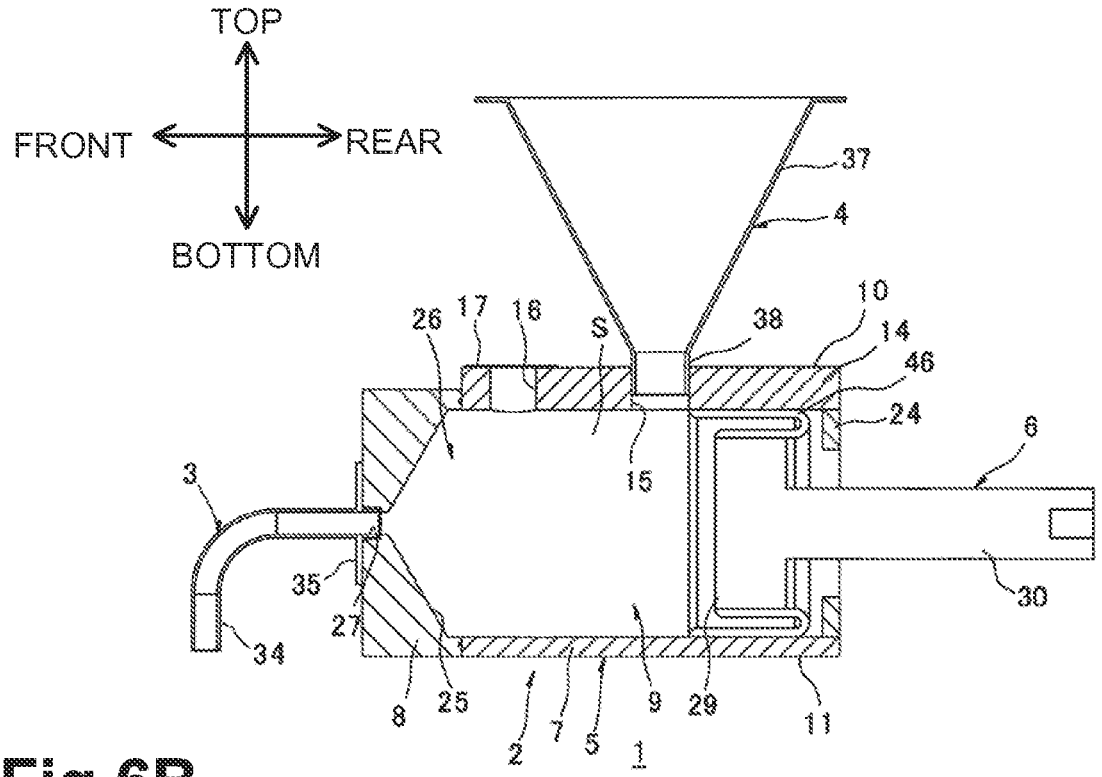
Figure 6B:
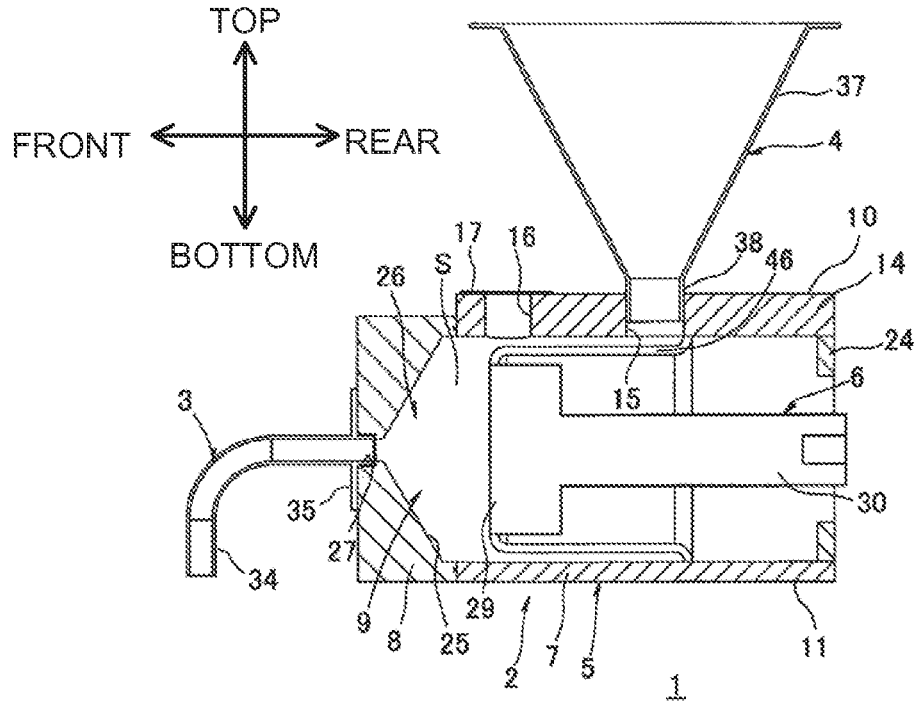

As shown in FIG. 6A, the piston 6 is in the retracted position, and toner is supplied from the funnel 4 into the internal space S of the toner storing chamber 5. Then, as shown in FIG. 6B, the piston 6 is moved frontward to the compression position, such that toner is pressed and discharged from the nozzle 3. At this time, the elastic member 46 is elastically deformed to allow the piston head 29 to move in the toner storing chamber 5.

According to the piston 6, the elastic member 46 is interposed between the inner circumferential surface of the cylinder member 7 and the outer circumferential surface of the piston head 29. Thus, even if toner enters between the inner circumferential surface of the cylinder member 7 and the outer circumferential surface of the piston head 29, toner is not subjected to friction therebetween. Thus, the potential for toner deterioration can be reduced, and the potential for accumulation of toner therebetween can be effectively reduced.

A fifth illustrative embodiment will be described with reference to FIG. 7.

The first embodiment illustrates the air outlet 16 disposed in the protruding portion 14 of the cylinder member 7. As shown in FIG. 7, the air outlet 16 may be disposed in the piston 6.

Figure 7:
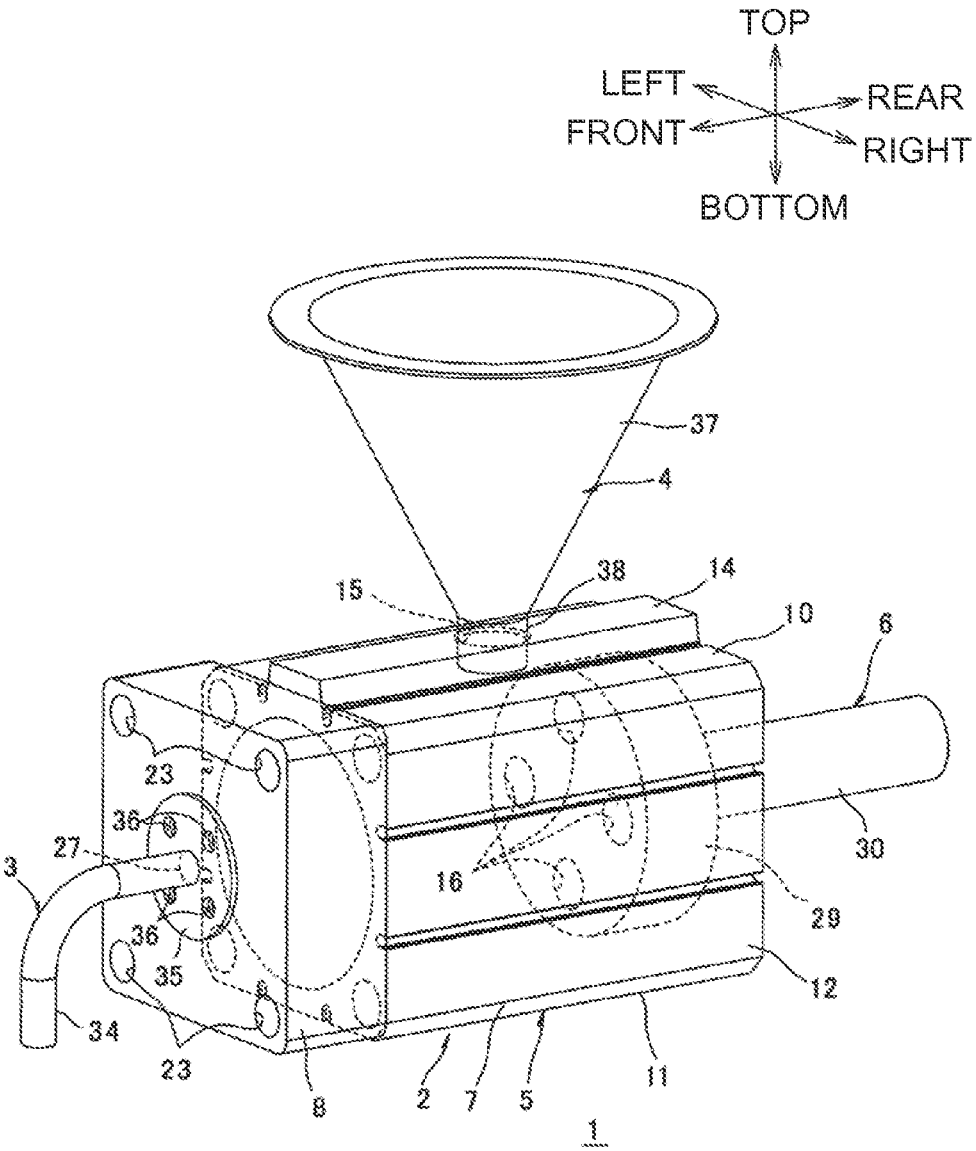
FIG. 7 is a perspective view, looking from the front right side from above, of a toner filling apparatus according to a fifth illustrative embodiment of the toner filling apparatus of the disclosure.

In FIG. 7, air outlets 16 are formed in the piston head 29 of the piston 6, not in the protruding portion 14 of the cylinder member 7.

More specifically, four air outlets 16 are spaced apart from each other vertically and horizontally in the piston head 29. Each of the air outlets 16 is formed through the piston head 29 in its thickness direction or front-rear direction.

Mesh filters (not shown) are affixed to the rear surface of the piston head 29 to cover the air outlets 16 respectively.

The air outlets 16 formed in the piston head 29 allow air to be efficiently released from the internal space S in the toner chamber 5.

A sixth illustrative embodiment will be described with reference to FIG. 8.

The first embodiment illustrates the shutter 18 configured to open and close in response to movement of the piston 6. As shown in FIG. 8, the shutter 18 may be configured to open and close regardless of the movement of the piston 6.

Figure 8:
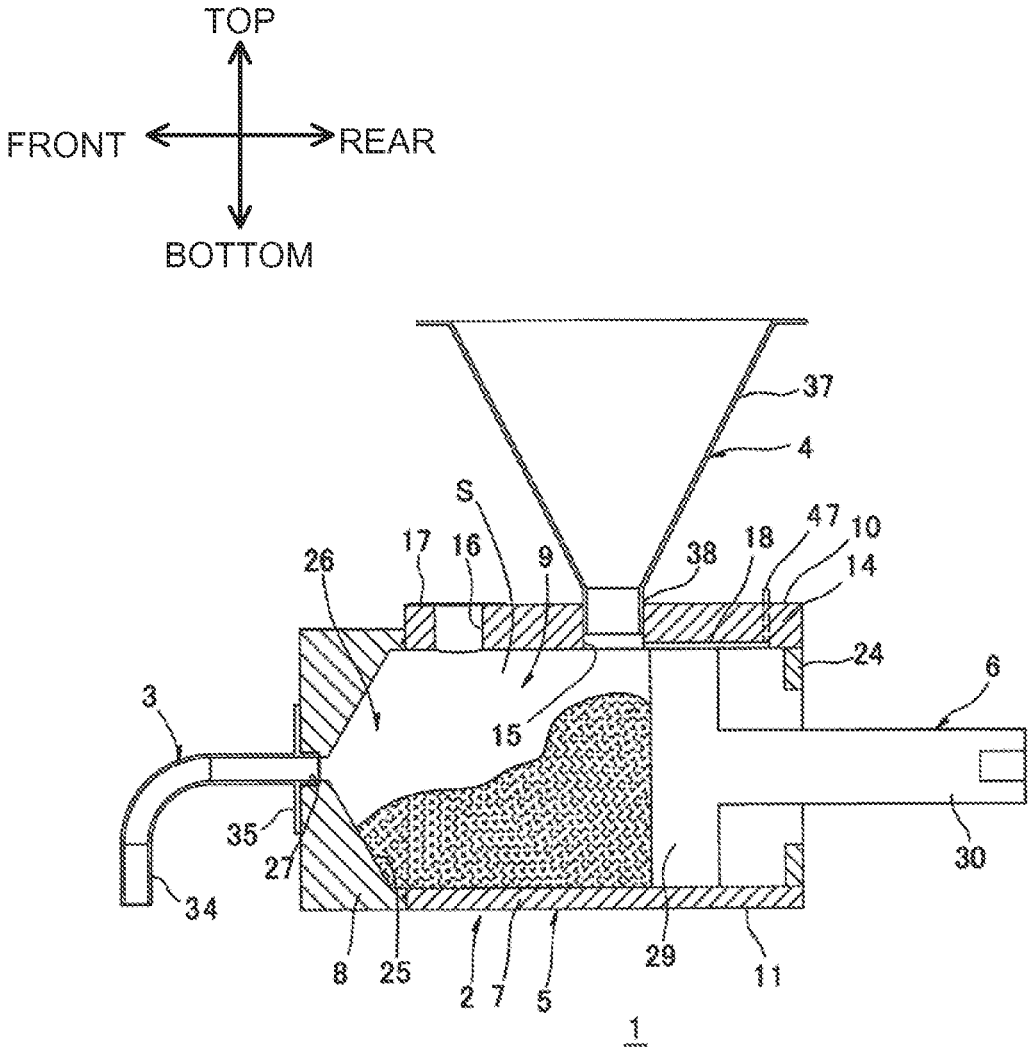
FIG. 8 is a sectional view of a toner filling apparatus according to a sixth illustrative embodiment of the toner filling apparatus of the disclosure.

In FIG. 8, the shutter 18 includes an operation member 47 instead of the front-side engaging portion 19 and the rear-side engaging portion 20.

More specifically, the protruding portion 14 of the cylinder member 7 has a slit (not shown) vertically passing therethrough along the front-rear direction in the center of the protruding portion 14 in the left-right direction. The operating member 47 stands on the upper surface of the shutter 18 such that the operating member 47 protrudes upward from the protruding portion 14 through the slit (not shown).

The shutter 18 is configured to be opened and closed by moving the operating member 47 frontward or rearward.

The shutter 18 can be opened and closed at a specified time, as it is open and closed independently of the movement of the piston 6.

A seventh illustrative embodiment will be described with reference to FIG. 9.

As shown in FIG. 9, the seventh embodiment illustrates the nozzle portion 34 having a narrow portion 41 at an end.

In FIG. 9, the narrow portion 41 is disposed on a downstream end of the nozzle portion 34 in a toner discharge direction in which toner is discharged, and is shaped like a funnel of which cross sectional area of an opening narrows toward a downstream side in the toner discharge direction.

The density of toner pressed by the piston 6 can be increased in the narrow portion 41.

Figure 10:
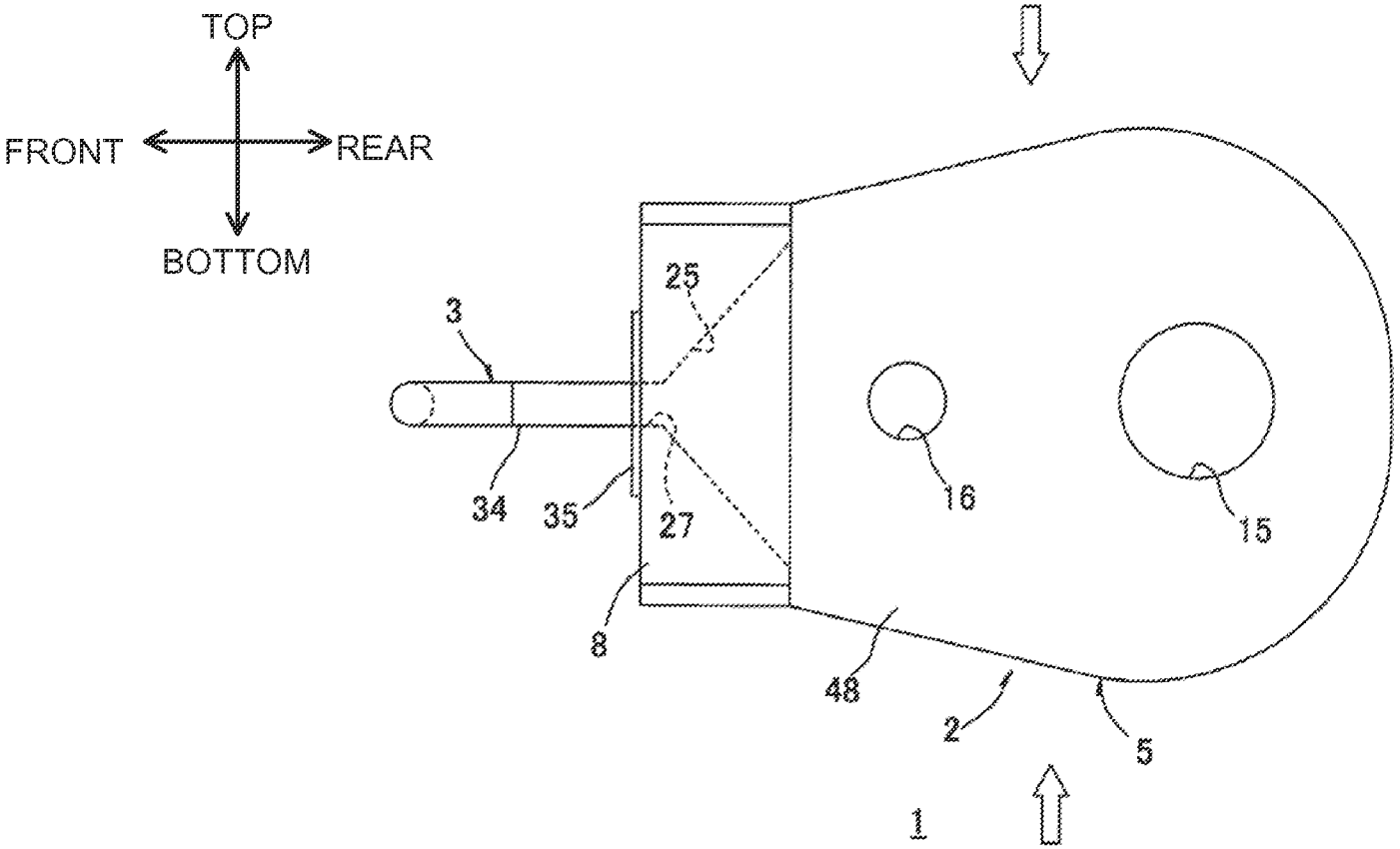
FIG. 10 is a plan view of a toner filling apparatus according to an eighth illustrative embodiment of the toner filling apparatus of the disclosure.

An eighth illustrative embodiment will be described with reference to FIG. 10.

The first embodiment illustrates the toner storing portion 2 including the toner storing chamber 5 and the piston 6. As shown in FIG. 10, the toner storing portion 2 may be formed of an elastic material, e.g., a rubber, so as to store and press toner therein.

More specifically, in the eighth embodiment, the cylinder member 7 and the piston 6 of the first embodiment are replaced with an elastic container 48, which is formed of an elastic material, e.g., a rubber, and configured to extend and contract.

The elastic container 48 is formed in a bag whose front is openable, and a front end portion of the elastic container 48 is attached to the nozzle mounting member 8.

The elastic container 48 includes the toner supply port 15 at the rear side and the air outlet 16 at the front side.

In the eighth embodiment, when the elastic container 48, into which toner has been supplied from the toner supply port 15, is pressed from left and right sides as shown by arrows, the elastic container 48 contracts and toner supplied in the elastic container 48 is pressed to high density. In addition, only air, which exists with toner in the elastic container 48, is released outside from the air outlet 16, and high-density toner is discharged from the nozzle 3.

The above embodiments show, but are not limited to, one air outlet 16. A plurality of air outlets may be disposed as appropriate.

In the above embodiments, a shutter may be disposed at the toner outlet 27.

In the above embodiments, the nozzle portion 34 may be made of hard material, e.g. metal, further made of flexible material, e.g. rubber. If the nozzle portion 34 is made of a flexible material, an orientation and a position of a discharge end of the nozzle portion 34 may be freely changed.

In the above embodiments, the toner filling apparatus 1 is installed horizontally. However, the toner filling apparatus 1 may be installed vertically. For example, in the first embodiment, the nozzle mounting member 8 may be set on the horizontal surface, such that the piston may be disposed above the nozzle mounting member 8.

In the above embodiments, toner can be charged into a plurality of toner cartridges 39 at a time during reciprocation of the piston 6.

In the above embodiments, toner may be charged into the toner cartridge 39 while the weight of the toner cartridge 39 is measured. In this case, when the weight of the toner cartridge 39 reaches a predetermined weight, the movement of the piston 6 may be stopped and toner filling may be completed.

Although an illustrative embodiment and examples of modifications of the present disclosure have been described in detail herein, the scope of the disclosure is not limited thereto. It will be appreciated by those skilled in the art that various modifications may be made without departing from the scope of the disclosure. Accordingly, the embodiment and examples of modifications disclosed herein are merely illustrative. It is to be understood that the scope of the disclosure is not to be so limited thereby, but is to be determined by the claims which follow.

What is claimed is:

1. A toner filling apparatus comprising:

a storing portion including:

a storing chamber configured to store toner therein; and a pressing member configured to press the toner stored in the storing chamber horizontally; and a nozzle for ejecting the toner pressed by the pressing member outside from the storing chamber, wherein the storing chamber has an air outlet for releasing air outside from the storing chamber when the pressing member presses the toner and a toner outlet for providing communication between the storing chamber and the nozzle, the air outlet being located in an upper downstream portion of the storing chamber in a pressing direction in which the pressing member presses the toner horizontally, the toner outlet being located downstream of the air outlet in the pressing direction, wherein the storing chamber has a toner supply port for supplying the toner in the storing chamber, and wherein the storing chamber includes a shutter configured to open and close the toner supply port, and the pressing member is configured to move the shutter to open and close the toner supply port.

2. The toner filling apparatus according to claim 1, wherein the air outlet is located downstream from the toner supply port in the pressing direction.

3. The toner filling apparatus according to claim 1, wherein the toner outlet is located downstream from the toner supply port in the pressing direction.

4. The toner filling apparatus according to claim 1, wherein the storing chamber defines a toner storing space, and a part of the toner storing space gradually narrows to the toner outlet.

5. The toner filling apparatus according to claim 1, wherein the storing chamber extends in a direction toward the toner outlet, and the pressing member is configured to press the toner toward the toner outlet.

6. The toner filling apparatus according to claim 1, wherein the storing chamber includes a top wall having a surface extending at least partially in the pressing direction, a bottom wall vertically spaced apart from the top wall, and a side wall connecting the top wall and the bottom wall, and the toner outlet is located above a vertical center of the side wall.

7. The toner filling apparatus according to claim 1, wherein the storing chamber includes a top wall having a surface extending at least partially in the pressing direction, and the top wall has the air outlet.

8. The toner filling apparatus according to claim 1, wherein a part of the nozzle is located above the toner outlet vertically.

9. The toner filling apparatus according to claim 1, further comprising a mesh member covering the air outlet, the mesh member being configured to prevent passage of the toner and allow escape of air.

10. The toner filling apparatus according to claim 1, wherein the pressing member includes a piston configured to move in the storing chamber.

11. The toner filling apparatus according to claim 10, wherein the pressing member includes an elastic member connected to an inner circumferential surface of the storing chamber and an outer circumferential surface of the piston, the elastic member is configured to be elastically deformed so as to allow the piston to move in the storing chamber, and the piston and the elastic member partition the storing chamber into an upstream-side space and a downstream-side space in a direction where the piston is advanced.

12. The toner filling apparatus according to claim 1, wherein the storing portion includes an elastic container configured to extend and contract, the elastic container functions as the storing chamber and the pressing member, and the elastic container has the air outlet.

13. The toner filling apparatus according to claim 1, wherein the nozzle includes a narrow portion at a downstream end of the nozzle.

14. A method of manufacturing a toner cartridge using a toner filling apparatus, the toner filling apparatus including a nozzle, a storing chamber, and a pressing member, the toner filling apparatus having an air outlet, and the storing chamber having a toner supply port and a shutter configured to open and close the toner supply port, the method comprising the steps of:

connecting the nozzle of the toner filling apparatus with a toner filling port of the toner cartridge;

locating the pressing member in a retracted position;

supplying toner to the storing chamber of the toner filling apparatus via the toner supply port after the locating step;

moving the pressing member to press the toner toward the nozzle horizontally until a predetermined amount of the toner is discharged into the toner cartridge via the nozzle and the toner filling port after the connecting step and the supplying step;

moving the shutter to close the toner supply port in accordance with horizontal movement of the pressing member in the moving step;

releasing air outside from the storing chamber via the air outlet in accordance with horizontal movement of the pressing member in the moving step;

disconnecting the nozzle of the toner filling apparatus from the toner filling port of the toner cartridge after the moving step; and closing the toner filling port of the toner cartridge after the disconnecting step.

* * * * *